US010138741B2

(12) United States Patent
Littler et al.

(10) Patent No.: US 10,138,741 B2
(45) Date of Patent: Nov. 27, 2018

(54) BLADED ROTOR

(71) Applicant: ROLLS-ROYCE PLC, London (GB)

(72) Inventors: Graham Robert Littler, Nottingham (GB); Geoffrey Alan Bye, Derby (DE)

(73) Assignee: ROLLS-ROYCE plc, London (GB)

( * ) Notice: Subject to any disclaimer, the term of this patent is extended or adjusted under 35 U.S.C. 154(b) by 251 days.

(21) Appl. No.: 14/631,111

(22) Filed: Feb. 25, 2015

(65) Prior Publication Data

US 2015/0260049 A1 Sep. 17, 2015

(30) Foreign Application Priority Data

Mar. 12, 2014 (GB) ..... 1404362.4

(51) Int. Cl.
*F01D 5/30* (2006.01)
*F01D 5/12* (2006.01)
(Continued)

(52) U.S. Cl.
CPC ..... *F01D 5/3015* (2013.01); *F01D 5/025* (2013.01); *F01D 5/12* (2013.01); *F01D 5/326* (2013.01);
(Continued)

(58) Field of Classification Search
CPC ..... F01D 5/12; F01D 5/025; F01D 5/3007; F01D 5/3015; F01D 5/3023; F01D 5/323;
(Continued)

(56) References Cited

U.S. PATENT DOCUMENTS 5,320,492 A * 6/1994 Bouru ..... F01D 5/3015 416/220 R
5,330,324 A 7/1994 Agram et al.
(Continued)

FOREIGN PATENT DOCUMENTS

EP 1 217 168 A1 6/2002
EP 1 760 259 A2 3/2007
(Continued)

OTHER PUBLICATIONS

Aug. 3, 2015 extended Search Report issued in European Patent Application No. 15156496.0.
(Continued)

*Primary Examiner* — Richard Edgar
*Assistant Examiner* — Alexander White
(74) *Attorney, Agent, or Firm* — Oliff PLC

(57) ABSTRACT

There is proposed a bladed rotor for a turbo-machine, the rotor having a rotational axis and including a hub defining a plurality of circumferentially spaced-apart slots around its periphery. Each slot slideably receives a root portion of a respective rotor blade, the root portion of each blade defining a radially inwardly open retaining groove within which a respective region of a retaining ring locates to retain the blades in said slots. The retaining ring also engages within a plurality of radially inwardly open hub grooves formed around the hub. The retaining ring engages each said hub groove such that a radial gap is defined between the retaining ring and a radially outermost region of each hub groove.

16 Claims, 5 Drawing Sheets

(51) Int. Cl.
*F01D 5/02* (2006.01)
*F01D 5/32* (2006.01)
*F01D 11/00* (2006.01)

(52) U.S. Cl.
CPC ..... *F01D 11/006* (2013.01); *F01D 11/008* (2013.01); *F05D 2220/30* (2013.01); *F05D 2230/60* (2013.01); *F05D 2250/182* (2013.01)

(58) Field of Classification Search
CPC .... F01D 5/326; F01D 11/006; F05D 2220/30; F05D 2230/60; F05D 2250/182; F05D 2260/30
See application file for complete search history.

(56) References Cited

U.S. PATENT DOCUMENTS

| | | | | |
|---|---|---|---|---|
| 5,622,476 | A * | 4/1997 | Adde | F01D 5/323 416/220 R |
| 6,234,756 | B1 * | 5/2001 | Ress, Jr. | F01D 5/30 29/525.02 |
| 2011/0123341 | A1 | 5/2011 | Aubin et al. | |
| 2012/0201681 | A1 * | 8/2012 | Chauveau | F01D 5/3015 416/204 A |

FOREIGN PATENT DOCUMENTS

| | | | |
|---|---|---|---|
| FR | 2729709 | A1 | 7/1996 |
| GB | 2 268 979 | A | 1/1994 |

OTHER PUBLICATIONS

Oct. 24, 2014 Search Report issued in United Kingdom Application No. GB1404362.4.

* cited by examiner

BLADED ROTOR

CROSS-REFERENCE TO RELATED APPLICATIONS

This application is based upon and claims the benefit of priority from British Patent Application Number 1404362.4 filed 12 Mar. 2014, the entire contents of which are incorporated by reference.

BACKGROUND

1. Field of the Disclosure

The present disclosure relates to a bladed rotor, and more particularly relates to a bladed rotor for a turbo-machine such as a gas turbine engine. The disclosure is particularly suited for use in gas turbine compressor rotors, although it is to be appreciated that the disclosure is not limited to compressor rotors and could find application in other types of bladed rotors for use in other types of turbo-machines.

2. Description of the Related Art

Conventional axial compressor rotors for gas turbine engines typically comprise a number of discs which are bolted or welded together to form an integral rotatable drum. Each disc can be considered to represent a central hub around which a plurality of rotor blades of aerofoil configuration are mounted. Each rotor blade is normally attached to the hub using a mechanical connection known as a root fixing. One such type of arrangement involves axially fixing the rotor blades to the periphery of the hub and involves the provision of a series of slots which are machined into the peripheral region of the hub and which are generally elongate parallel to one another. The slots are typically arranged so that they extend in a lengthwise direction which makes an acute angle of between 10 and 30 degrees to the rotational axis of the hub. Each slot is configured to receive a dove-tail or fir-tree shaped root fixing of a respective rotor blade.

A radially outwardly biased sprung retaining ring is normally used to secure the root portions of the rotor blades within their respective mounting slots. The retention ring locates within radially inwardly open grooves formed around the hub at positions located between the blade mounting slots, under its radially outward bias. Similar grooves are provided on the rotor blades and so the retaining ring also locates in the blade grooves to axially retain the root portions of the blades in the mounting slots.

It is important for integrity reasons that during operation of the rotor that the retaining ring does not apply radial load to the blades within the blade grooves. The retaining ring must at all times remain radially inwardly spaced from the radially outmost region of each blade groove by a clearance gap. It is therefore normal to configure the arrangement such that the retaining ring only bears against the radially outmost regions of the hub grooves.

However, it has been found that during service the retaining rings of the above-described type of axial fixing arrangement can be susceptible to wear on their radially outmost surfaces, as also can the inner surfaces of the hub grooves within which the rings locate. Over time, this wear can reduce the size of the radial clearance gap between the retaining ring and the blade grooves which, as indicated above, cannot be allowed to occur due to integrity concerns.

OBJECTS AND SUMMARY

It is an object of the present disclosure to provide an improved bladed rotor for a turbo-machine.

According to the present disclosure, there is provided a bladed rotor for a turbo-machine, the rotor having a rotational axis and comprising a hub defining a plurality of circumferentially spaced-apart slots around its periphery, each slot slideably receiving a root portion of a respective rotor blade, the root portion of each blade defining a radially inwardly open retaining groove within which a respective region of a retaining ring locates to retain the blades in said slots without the retaining ring making contact with a radially outermost region of the blade retaining groove, the retaining ring also engaging within a plurality of radially inwardly open hub grooves formed around the hub, wherein the retaining ring engages each said hub groove such that a radial gap is defined between the retaining ring and a radially outermost region of each hub groove.

Each said hub groove may define a respective radially outermost internal surface and the retaining ring engages the hub grooves in radially spaced relation to said radially outermost internal surfaces.

Said engagement of the retaining ring within said hub grooves may be effective to maintain a radial gap between the retaining ring and a radially outermost region of each said retaining groove.

Said retaining ring may define a first contact surface on a first flank of the ring for engagement within each said hub groove, said first contact surface lying at an acute angle to a plane orthogonal to the rotational axis of the rotor.

Said hub grooves may each define a corresponding internal contact surface for contact with said contact surface of the retaining ring, each said internal contact surface lying at a substantially equal acute angle to a plane orthogonal to the rotational axis of the rotor as said first contact surface of the retaining ring.

Said retaining ring may be urged into engagement with said hub grooves such that said first contact surface of the retaining ring makes contact with the internal contact surface of each hub groove over a contact area which is greater than the area of the radially outermost internal surface of each hub groove.

Said retaining ring may define a second contact surface on an oppositely directed flank of the ring and which lies in a plane orthogonal to the rotational axis, the second contact surface of the ring being urged into contact with a radial surface of the hub.

Said second contact surface of the retaining ring may also be urged into contact with a respective radial surface of the root portion of each rotor blade.

Said second contact surface of the retaining ring may extend radially across an interface between the hub and the root portion of each rotor blade at the circumferential position of each rotor blade.

Said retaining ring may have at least a region which is tapered in radial cross-section so as to narrow in a radially outward direction.

Said region of the retaining ring may be frustoconical in radial cross-section.

Said retaining ring may be radially outwardly biased.

The radially outwards bias of said retaining ring may be effective to urge the retaining ring into said engagement with said hub grooves.

Said hub grooves may be circumferentially interspaced between said retaining grooves.

The bladed rotor may be provided in the form of a compressor rotor for a gas turbine engine.

BRIEF DESCRIPTION OF THE DRAWINGS

So that the disclosure may be more readily understood, and so that further features thereof may be appreciated, embodiments of the disclosure will now be described by way of example with reference to the accompanying drawings in which.

DETAILED DESCRIPTION OF EMBODIMENTS

Figure 1:
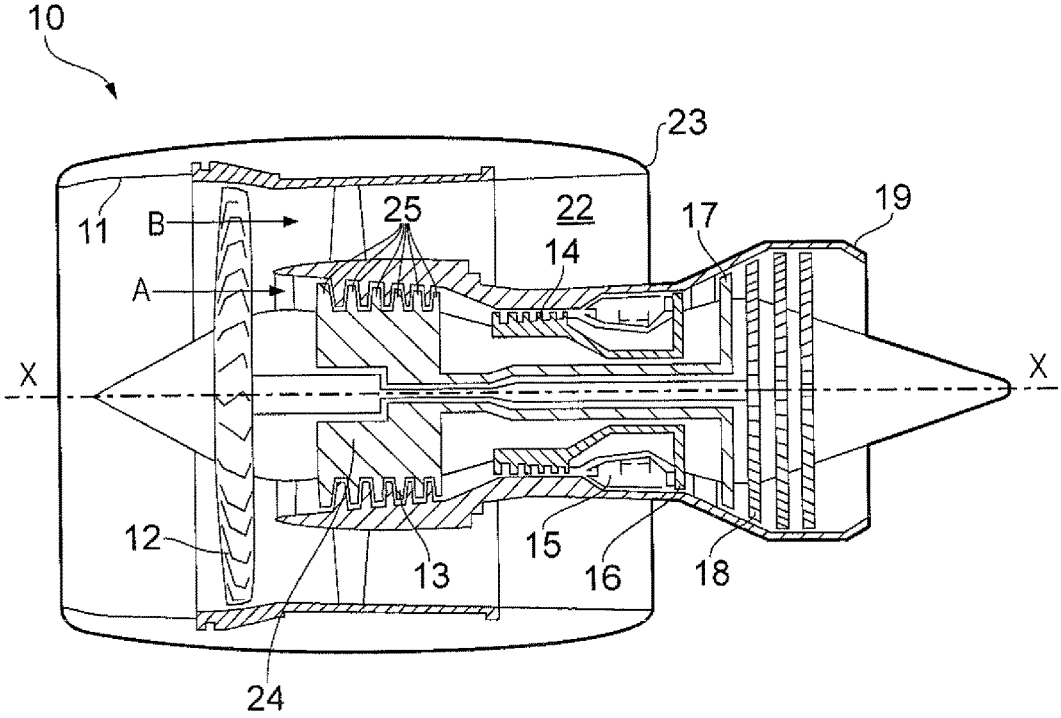
FIG. 1 is a longitudinal cross-sectional view through a gas turbine engine.

Turning now to consider the drawings in more detail FIG. 1 illustrates a ducted fan gas turbine engine of a type which may incorporate the present disclosure. The engine is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Each of the compressors 13, 14 of the engine 10 are of a multi-stage design. For example, having regard to the intermediate pressure compressor 13, it will be noted that the compressor 13 has a rotor 24 having six rows 25 of rotor blades arranged in axial series.

Figure 2:
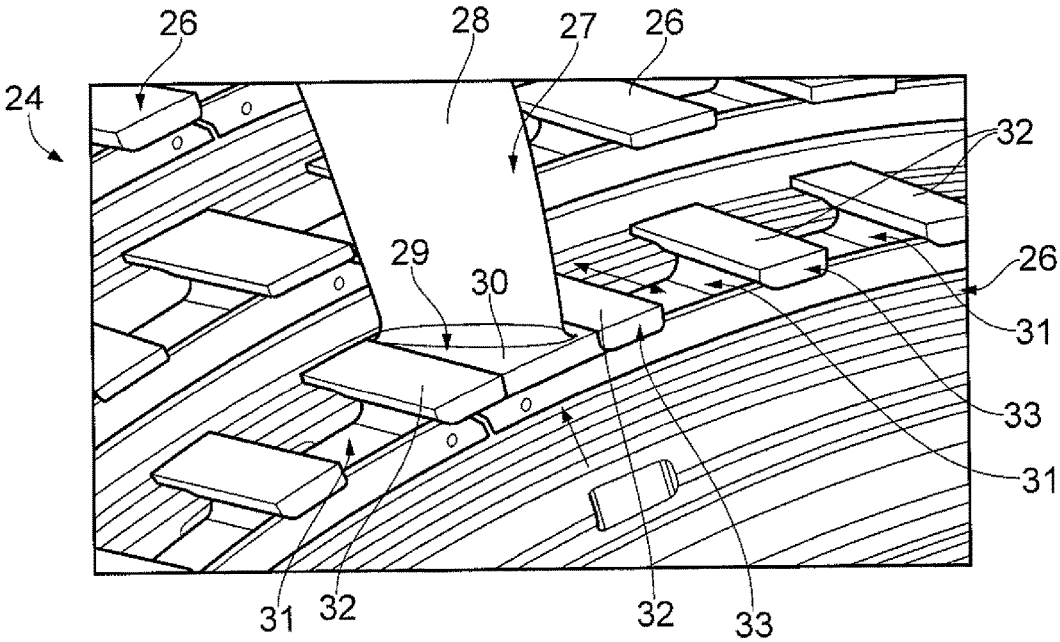
FIG. 2 is a perspective view of part of a compressor rotor of a prior art design but which is useful for a proper understanding of the present disclosure, showing in detail an arrangement for axially fixing rotor blades to the rotor.

FIG. 2 illustrates part of a multi-stage compressor rotor 24 according to a prior art design but which nevertheless shares several features with the rotor of the present disclosure. The rotor is 24 made up of a number of central hubs 26 which are affixed to one another, for example by the use of welds or bolts, and which are thus arranged for co-rotation about a common rotational axis which will be coincident with the rotational axis X-X of the compete engine 10. A plurality of generally radially extending rotor blades 27 (only one being illustrated in FIG. 2) are affixed around the periphery of each hub 26, in circumferentially spaced relation to one another.

Each rotor blade 27 has an aerofoil region 28 and a radially innermost root portion 29 which includes a platform 30 and a dovetail or fir-tree part (not shown) which is configured for sliding engagement within a respective mounting slot 31 formed around the periphery of the central hub 26 in a conventional manner. As shown in FIG. 2, the mounting slots 31 are elongate and spaced circumferentially from one another around the periphery of the hub 26. It is envisaged that the slots will be oriented such that they are parallel to one another and extend in a lengthwise direction which makes an acute angle of between 10 and 30 degrees to the rotational axis of the hub.

The mounting slots 31 are defined between circumferentially spaced apart ribs 32 which are each formed as an integral part of the hub 26. As illustrated most clearly in FIG. 2, the ribs 32 each define a smooth outer surface which interfaces smoothly with a radially outwardly directed surface of the root platform 30 of an adjacent blade 27. The ribs 32 each have an axial length which is slightly longer than the axial length of the slots 31 therebetween, and thus present a short overhanging region 33, within which there is formed a radially inwardly open hub groove 34 (shown most clearly in FIG. 5). Each hub groove 34 extends completely across the circumferential width of its respective rib, and is thus open at both ends.

As will be noted from FIG. 2, the root platform 30 of each rotor blade 27 has an axial length which is substantially equal to the axial length of each rib 32, whilst the dovetail or fir-tree part of the blade root has an axial length which is equal to the length of the slot 31 within which it is received. The root platform 30 thus also presents a short overhanging region 35 which projects axially past the end of the mounting slot 31. A radially inwardly open retaining groove 36 (shown most clearly in FIG. 5) is formed in the overhanging region 35 of each blade 27. Each retaining groove 36 extends completely across the circumferential width of its respective blade platform 30, and is thus open at both ends. As will also be appreciated from FIG. 5, when the blades 27 are fully received within their respective mounting slots 31, their respective retaining grooves 36 are interspaced between and radially aligned in end-to-end relationship with the hub grooves 34 formed in the ribs 32. The hub grooves 34 and the blade retaining grooves 36 thus cooperate to define an annular channel all the way around the rotor.

Figure 3:
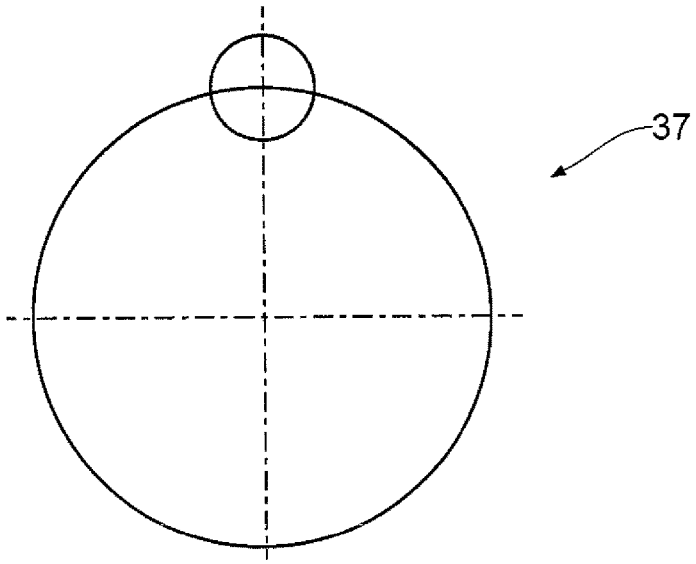
FIG. 3 is shows a retaining ring used in the arrangement of FIG. 2.
Figure 4:
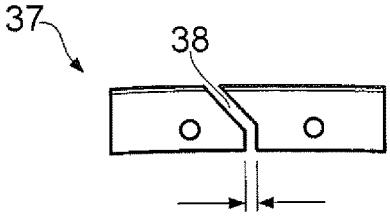
FIG. 4 shows a region of the retaining ring of FIG. 3 in more detail.

FIGS. 3 and 4 illustrate a retaining ring 37 (only part of the ring being shown in FIG. 4), which is used to retain the blades 27 within their respective mounting slots 31. The retaining ring 37 is of a generally flat and circular configuration, and is provided with a break or discontinuity 38 at one position around its circumference. The retaining ring 37 is preferably made from metal, and is configured so as to have an inherent radially outward bias. The ring is thus outwardly sprung, and has a relaxed radius which is slightly larger than the radius of the channel defined by the cooperating hub grooves 34 and blade retaining grooves 36. However, the discontinuity 38 permits the ring to be compressed radially inwardly to a smaller diameter, against its radial bias.

Figure 5:
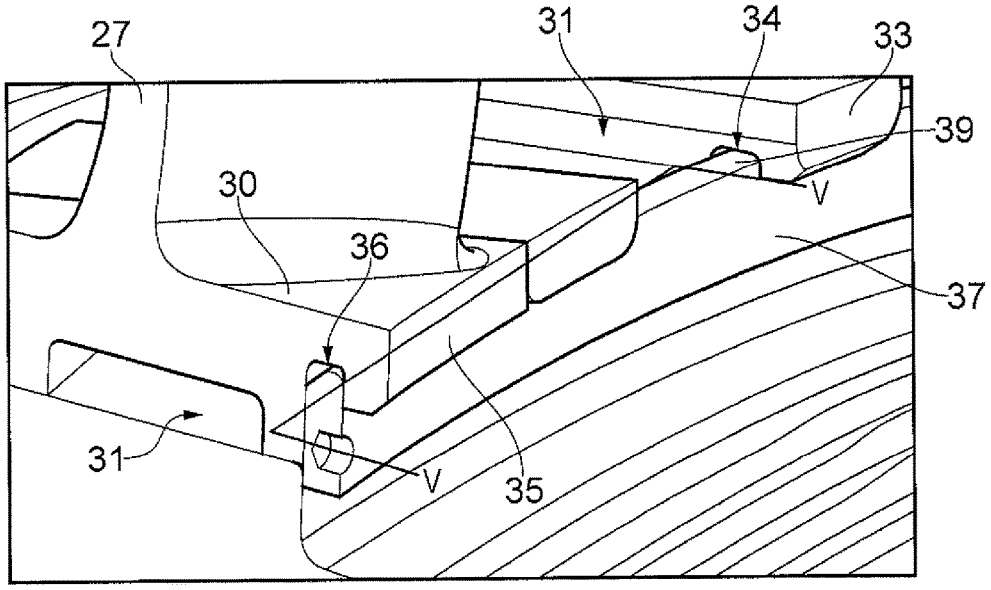
FIG. 5 is an enlarged perspective view of the fixing arrangement illustrated in FIG. 4.

As illustrated in FIGS. 2 and 5, the retaining ring 37 is engaged within the spaced apart hub grooves 34 around the hub 26, and also locates within the retaining grooves 36 of the blades 27 which are interspaced between the hub grooves 34 formed by the ribs 32. This may be achieved by slideably engaging a respective rotor blade 27 within each mounting slot 31; radially compressing the retaining ring 37 against its bias; aligning the retaining ring 37 inside the channel defined by the hub grooves 34 and the blade retaining grooves 36, and then allowing the retaining ring 37 to expand radially outwardly towards its relaxed condition, whereupon the ring will engage within the hub grooves 34 and locate within the aligned retaining grooves 37 of the blades 27.

Figure 6:
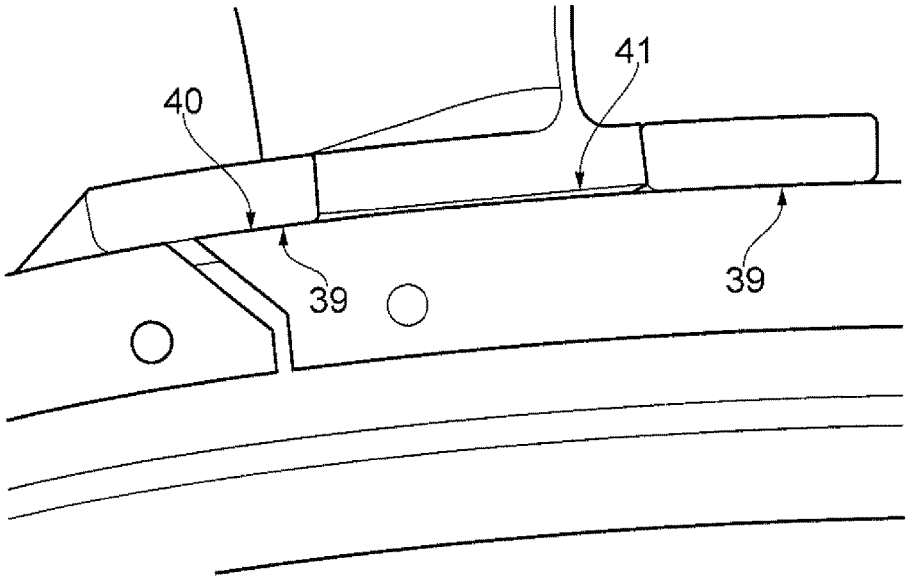
FIG. 6 is a radial cross-sectional view along line V-V in FIG. 5.

As illustrated most clearly in FIG. 6, the prior art arrangement is configured such that the radially outermost part 39 of the retaining ring 37 engages the radially outermost region 40 of each hub groove 34. This engagement occurs because the relaxed radius of the outsprung ring 37 is greater than the radius, as measured from the hub's axis of rotation, of the hub grooves 34. However, it will be noted that the radially outermost region 40 of the ring 37 does not engage, or make any contact with, the radially outermost region 41 of each blade retaining groove 36, in order to satisfy the integrity requirements mentioned above.

Turning now to consider FIGS. 6 and 7, an embodiment of the present disclosure will be described, noting that features and integers which are identical or similar to those of the prior art arrangement described above will be identified with the same reference numbers.

Figure 7:
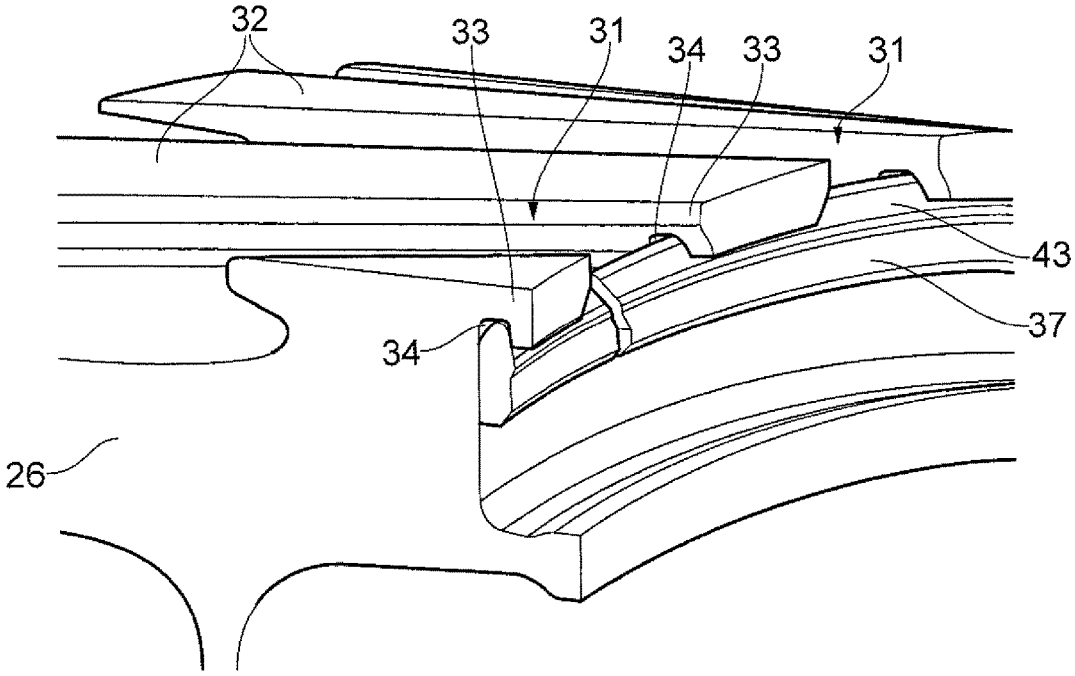
FIG. 7 is a perspective view of a part of a rotor arrangement in accordance with the present disclosure.

FIG. 7 shows a circumferential region of a central hub 26 which may form part of a rotor 24 generally similar to the type described above. The hub is shown without any rotor blades 27 mounted to it, for reasons of clarity. However, it is to be appreciated that a plurality of rotor blades 27 of similar configuration to those described above may be mounted around the periphery of the hub 26 in a generally similar manner to that described above. To that end, it will be noted that the hub 26 has a plurality of mounting slots 31 formed around the periphery of the central hub 26 in a conventional manner. The mounting slots 31 are elongate and spaced circumferentially from one another around the periphery of the hub 26, and are each arranged so extend substantially parallel to the rotational axis of the hub in their length direction.

The mounting slots 31 are again defined between circumferentially spaced apart ribs 32 which are each formed as an integral part of the hub 26. The ribs 32 each have an axial length which is slightly longer than the axial length of the slots 31 therebetween, and thus present a short overhanging region 33, within which there is formed a radially inwardly open hub groove 34. Each hub groove 34 extends completely across the circumferential width of its respective rib 32, and is thus open at both ends for alignment and cooperation with retaining grooves 36 formed in the rotor blades 27 in a similar manner to that described above with reference to FIGS. 2 to 6.

As also illustrated in FIG. 7, a retaining ring 37 is again provided to retain the blades 27 within their respective mounting slots 31 in a generally similar manner to that described above, albeit with some notable differences which will be described in detail below. The retaining ring 37 is again provided with a break or discontinuity 38 at one position around its circumference, may be made from metal, and is configured so as to have an inherent radially outward bias, The ring is thus outwardly sprung, and may be engaged within the hub grooves 34 and thus located within the blade retaining grooves 36 in a similar manner to that described above when the blades 27 are mounted within their respective mounting slots 31. However, in the arrangement of FIGS. 7 and 8 the retaining ring 37 and the hub grooves 34 in which it locates around the hub have a significantly different configuration to the arrangement of FIGS. 2 to 6.

Figure 8:
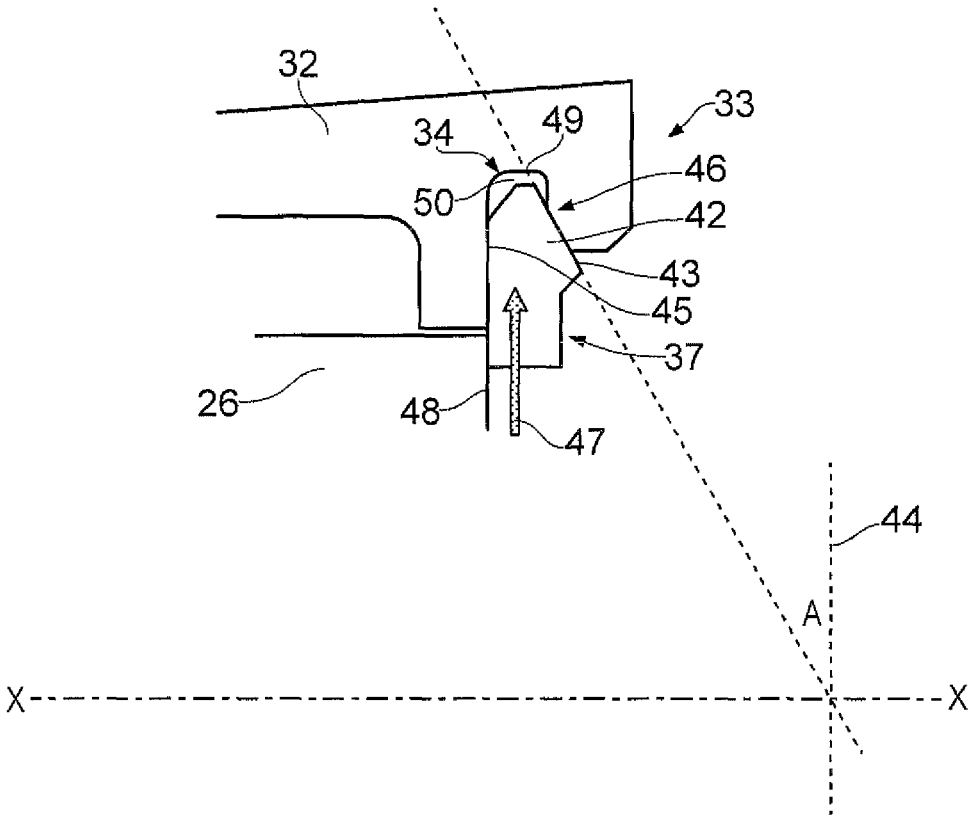
FIG. 8 is an axial cross-sectional view showing further detail of an arrangement in accordance with the disclosure showing the cooperation of a retaining ring and a hub groove.

Referring in particular to FIG. 8, it will be noted that the retaining ring 37 of this arrangement has a modified profile in radial cross-section. In particular, it will be noted that the ring 37 has a somewhat enlarged radially outermost region 42 of generally frustoconical form in radial cross-section, and which is tapered in radial cross-section so as to narrow in a radially outwards direction.

The enlarged frustoconical region 42 of the retaining ring defines a first contact surface 43 around a first flank of the ring. The first contact surface 43 is arranged to lie at an acute angle A to a plane 44 which is orthogonal to the rotational axis X-X of the rotor when the retaining ring is located within the hub grooves 34 as illustrated. The ring 37 furthermore defines a second contact surface 45 on an oppositely directed second flank of the ring, the second contact surface 45 lying in a plane orthogonal to the rotational axis X-X when the retaining ring is located within the hub grooves 34.

Turning now to consider the radial cross-sectional form of the hub grooves 34, it will be noted that each hub groove 34 defines a respective internal contact surface 46 which is arranged to lie at an equal angle to a plane 44 orthogonal to the rotational axis X-X as the first contact surface 43 of the ring 37. As will be noted from the FIG. 8, the internal contact surface 46 of each hub groove 34 is thus arranged to face generally towards the main body of the rotor hub 26 from which the overhanging region 33 of the respective rib 32 projects.

The retaining ring 37 and the hub grooves 34 are sized so that the retaining ring 37 engages within the hub grooves 34, under its radially outwardly directed bias as illustrated schematically by arrow 47 in FIG. 8, such that the first contact surface 43 of the ring 37 is brought into contact with and bears against the internal contact surface 46 of each hub groove 34. Because the internal contact surface 46 of the grooves 34 are arranged to face towards the main body of the rotor hub, the outward bias of the ring 37 also urges its second contact surface 45 into intimate contact with the adjacent radial surface 48 of the hub 26.

It is important to note, as illustrated in FIG. 8, that when the first contact surface 43 of the retaining ring 37 contacts the internal contact surface 46 of each hub groove 34, the ring 37 is radially inwardly spaced from a radially outermost internal surface 49 of the respective hub groove 34. A radial gap 50 is thus maintained between the retaining ring 37 and the radially outermost region of each hub groove 34. This radial gap 50 prevents wear on the outermost region of ring 37, and also the radially outermost region of the hub grooves 34, which as explained above in the introductory section can pose a significant risk to the integrity of the arrangement.

Furthermore, it is to be noted that the area over which the first contact surface 43 of the retaining ring 37 and the internal contact surface 46 of each hub groove 34 make contact with one another is greater than the area of the radially outermost internal surface 49 of each hub groove 34. The arrangement of the present disclosure thus provides a significantly enlarged contact area between the retaining ring 37 and each hub groove 34 than is the case in the above-described prior art arrangement, despite the hub grooves 34 having a generally comparable cross-sectional size.

Of course, as in the prior art arrangement described above and illustrated in FIGS. 2 to 6, the arrangement of the present disclosure is configured such that when the retaining ring 37 is fully engaged within the hub grooves 34 around the hub 24 of the rotor, the ring does not engage or make any contact with the radially outermost region of each blade retaining groove 36, for integrity reasons.

Figure 9:
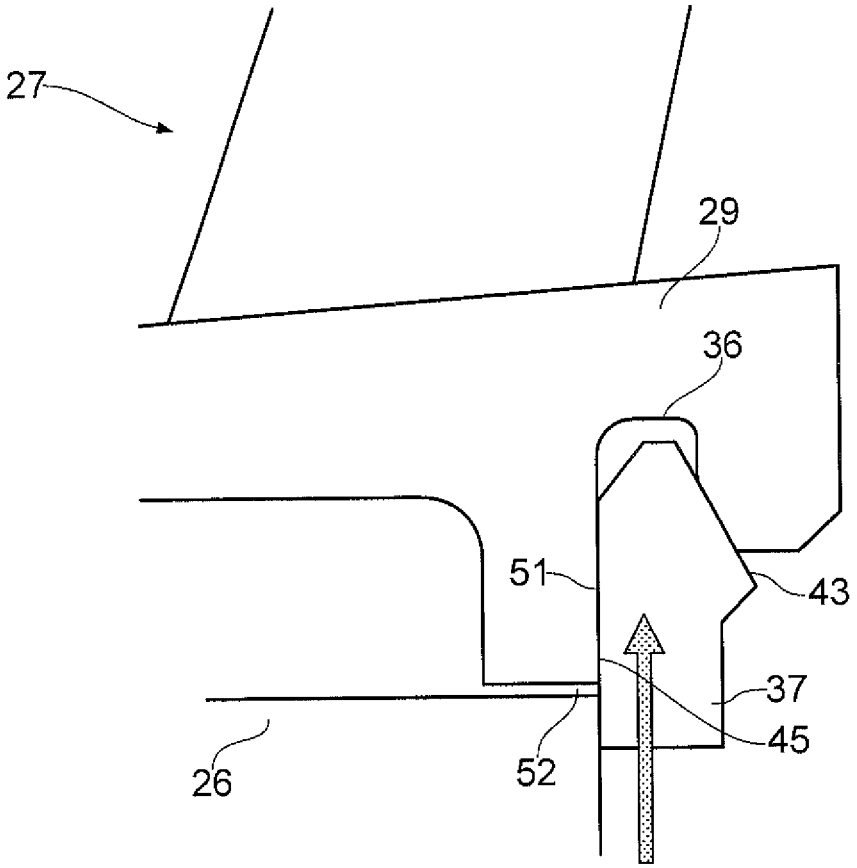
FIG. 9 is a view similar to that of FIG. 8, but which shows a circumferential position corresponding to that of a rotor blade.

The blade retaining grooves 36 of this arrangement do not necessarily have to have an identical or similar form to the hub grooves 34 described in detail above. However, for convenience FIG. 9 illustrates the root portion 29 of a rotor blade 27 which does have a blade retention groove 36 of similar form to the above-described hub grooves 34. More significantly, however, FIG. 9 illustrates a secondary benefit of the above-described manner in which the retaining ring 37 and the hub grooves 34 interact and engage, which arises from the angled nature of the first contact surface 43 of the ring 37 and the internal contact surfaces 46 of the hub grooves 34. As will be noted from FIG. 9, the outward bias of the retaining ring, and the angled nature of its contact with the hub grooves is effective to urge the second contact surface 45 into contact with a respective radial surface 51 of the root portion 29 of each rotor blade 27, at their positions interspaced circumferentially between the hub grooves 34 around the hub 26. Furthermore, as illustrated in FIG. 9, the second contact surface 45 of the retaining ring extends radially across the interface 52 between the hub 26 and the root portion 29 of each rotor blade 27, which provides a seal across the interface 52, thereby helping to prevent axial leakage of gas past the retention ring 37 at the circumferential positions of the rotor blades 27, which would adversely affect the efficiency of the engine 10 in the case of a compressor rotor 24.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

We claim:

1. A bladed rotor for a turbo-machine, the bladed rotor having a rotational axis and comprising a hub including a plurality of circumferentially spaced-apart ribs around the periphery of the hub, the ribs defining a plurality of spaced-apart slots, each of the spaced-apart slots slideably receiving a root portion of a respective rotor blade of a plurality of rotor blades, the respective root portion of each respective rotor blade of the plurality of rotor blades defining a radially inwardly open blade retaining groove within which a respective region of a retaining ring locates to retain each of the rotor blades in the respective spaced-apart slots without the retaining ring making contact with a radially outermost region of the respective blade retaining grooves, wherein the retaining ring also engages within a plurality of radially inwardly open hub grooves formed in the ribs spaced around the hub, the retaining ring engages each of the hub grooves such that a radial gap is defined between the retaining ring and a radially outermost region of each of the blade retaining grooves, and the engagement of the retaining ring within each of the hub grooves is effective to maintain a radial gap between the retaining ring and a radially outermost region of each of the blade retaining grooves wherein the retaining ring defines a first contact surface on a first flank of the retaining ring for engagement within each of the hub grooves, and the first contact surface lying at an acute angle to a plane orthogonal to the rotational axis of the bladed rotor, wherein each of the hub grooves defines a corresponding internal contact surface for contact with the first contact surface of the retaining ring, and the internal contact surface of each of the hub grooves lies at a substantially equal acute to a plane orthogonal to the rotational axis of the bladed rotor as the first contact surface of the retaining ring.

2. The bladed rotor according to claim 1, wherein each of the hub grooves defines a respective radially outermost internal surface, and the retaining ring engages the hub grooves in a radially spaced relation to the respective radially outermost internal surfaces.

3. The bladed rotor according to claim 1, wherein the retaining ring is urged into engagement with the hub grooves such that the first contact surface of the retaining ring makes contact with the internal contact surface of each of the hub grooves over a contact area which is greater than each respective area of the radially outermost internal surface of each of the hub grooves.

4. The bladed rotor according to claim , wherein the retaining ring defines a second contact surface on an oppositely directed flank of the retaining ring and which lies in a plane orthogonal to the rotational axis, and the second contact surface of the retaining ring is urged into contact with a radial surface of the hub.

5. The bladed rotor according to claim 4, wherein the second contact surface of the retaining ring is also urged into contact with a respective radial surface of the root portion of each of the rotor blades.

6. The bladed rotor according to claim 5, wherein the second contact surface of the retaining ring extends radially across an interface between the hub and the root portion of each of the rotor blades blade at a circumferential position of each of the rotor blades, which provides a seal across the interface, thereby helping to prevent axial leakage of gas past the retaining ring at the circumferential positions of the rotor blades.

7. The bladed rotor according to claim 1, wherein the retaining ring includes a region which is tapered in a radial cross-section so as to narrow in a radially outward direction.

8. The bladed rotor according to claim 7, wherein the region of the retaining ring which is tapered in the radial cross-section has a frustoconical radial cross-section shape.

9. The bladed rotor according to claim 1, wherein the retaining ring is radially outwardly biased.

10. The bladed rotor according to claim 9, wherein the radially outwards bias of the retaining ring is effective to urge the retaining ring into the engagement with the hub grooves.

11. The bladed rotor according to claim 1, provided in the form of a compressor rotor for a gas turbine engine.

12. The bladed rotor according to claim 1, wherein each hub groove extends completely across the circumferential width of its respective rib, and is thus open at both ends.

13. The bladed rotor according to claim 1, wherein a root platform of each rotor blade has an axial length which is substantially equal to an axial length of each rib, whilst a dovetail or fir-tree part of the blade root has an axial length which is equal to a length of the respective slot within which it is received.

14. The bladed rotor according to claim 1, wherein the retaining ring is urged into engagement with the hub grooves such that a first contact surface of the retaining ring makes contact with an internal contact surface of each of the hub grooves over a contact area which is greater than each respective area of the radially outermost internal surface of each of the hub grooves.

15. The bladed rotor according to claim 1, wherein the respective retaining grooves are interspaced between and radially aligned in end-to-end relationship with the hub grooves formed in the ribs.

16. The bladed rotor according to claim 1, wherein each of the hub grooves defines a corresponding internal contact surface for contact with a first contact surface of the retaining ring, and the internal contact surface of each of the hub grooves is arranged to face towards a main body of a hub of the bladed rotor, the outward bias of the retaining ring urging a second contact surface of the retaining ring into intimate contact with an adjacent radial surface of the hub of the bladed rotor.

* * * * *